US006860921B2

(12) United States Patent
Hopper

(10) Patent No.: US 6,860,921 B2
(45) Date of Patent: Mar. 1, 2005

(54) METHOD AND APPARATUS FOR SEPARATING LIQUID FROM A MULTI-PHASE LIQUID/GAS STREAM

(75) Inventor: Hans P. Hopper, Aberdeen (GB)

(73) Assignee: Cooper Cameron Corporation, Houston, TX (US)

( * ) Notice: Subject to any disclaimer, the term of this patent is extended or adjusted under 35 U.S.C. 154(b) by 25 days.

(21) Appl. No.: 10/375,482

(22) Filed: Feb. 27, 2003

(65) Prior Publication Data

US 2004/0168572 A1 Sep. 2, 2004

(51) Int. Cl.[7] ..... B01D 17/038; B01D 19/00

(52) U.S. Cl. ..... 95/261; 95/262; 96/208; 96/216; 96/220; 166/105.5; 166/265; 210/512.1; 210/787

(58) Field of Search ..... 96/216, 208, 220; 95/261, 262; 166/105.5, 265; 210/512.1, 512.2, 787

(56) References Cited

U.S. PATENT DOCUMENTS

| | | | | |
|---|---|---|---|---|
| 2,843,053 A | | 7/1958 | Carle | 166/189 |
| 3,624,822 A | * | 11/1971 | Carle et al. | 166/105.5 X |
| 4,481,020 A | | 11/1984 | Lee et al. | 96/214 |
| 4,805,697 A | | 2/1989 | Fouillout et al. | 166/265 |
| 4,900,433 A | | 2/1990 | Dean et al. | 210/170 |
| 5,482,117 A | | 1/1996 | Kolpak et al. | 166/265 |
| 5,698,014 A | | 12/1997 | Cadle et al. | 96/157 |
| 6,033,567 A | | 3/2000 | Lee et al. | 210/512.2 |
| 6,053,249 A | * | 4/2000 | Stevenson et al. | 166/265 X |
| 6,082,452 A | | 7/2000 | Shaw et al. | 166/105.5 |
| 6,155,345 A | * | 12/2000 | Lee et al. | 166/105.5 |
| 6,196,310 B1 | * | 3/2001 | Knight | 166/105.5 |
| 6,209,651 B1 | * | 4/2001 | Knight | 166/105.5 X |

* cited by examiner

*Primary Examiner*—Richard L. Chiesa
(74) *Attorney, Agent, or Firm*—Michael P. Hartmann; Peter Bielinski

(57) ABSTRACT

A tubular separation unit insertable into a caisson or tube for separating liquid from an upward flowing liquid/gas multi-phase stream, and including a centrifugal flow-induced liquid separator having a multi-phase gas/liquid inlet, a liquid outlet, and a gas stream outlet; a liquid transfer conduit connected to the liquid outlet of the flow separator; and a pump for pumping liquid, disposed below the separator and including a pump liquid inlet connected to the liquid transfer conduit and through which liquid separated in the separator is received, and a pumped liquid outlet through which separated liquid is, in use, caused to flow selectively.

33 Claims, 17 Drawing Sheets

METHOD AND APPARATUS FOR SEPARATING LIQUID FROM A MULTI-PHASE LIQUID/GAS STREAM

BACKGROUND OF THE INVENTION

1. Field of the Invention

The present invention relates to a method and apparatus insertable into a tubular pressure containing pipe (such as in an oil well), caisson, silo riser or conductor for separating liquid from an upward flowing liquid/gas multi-phase stream. More particularly, the method and apparatus are capable of providing a solution to the problem of eliminating and removing liquids from a multi-phase well or riser system where the build up of liquids can cause a significant loss of production.

FIG. 1 is a example schematic illustration of a typical hydrocarbon well completion. The well is not shown to scale. A multi-phase producing well such as illustrated in FIG. 1 may have its wellhead located on the sea-bed or on a platform or on land. For simplicity the invention described has the wellhead shown on the surface.

A well 1 has a production casing 2 at the top of which is secured a wellhead 3 and a tree 4. A production tubing string 5 is suspended within the casing 2. A tubing tail pipe 7 extends through a packer 8 into the live well above the shoe 6 on the casing 2 from the bottom of the production tubing 5. A smaller diameter casing liner with a shoe 9 may be positioned below the first shoe 6. Multi-phase hydrocarbon/water mixture from gas-bearing strata or zones 10, often many thousands of feet below the surface 11, enters the well above the shoes 6, 9 through appropriate ports or perforations indicated at 12 and flows upwardly through the tail pipe 7 and the tubing 5, via a sub-surface safety valve 13, into the tree 4 and from there through appropriate piping 14, to an export facility (not shown). The multi-phase flow enters above the shoes 6, 9 as indicated by the arrows, together with gas, liquid and vapour, at say a formation pressure $P_F$. Additional condensation of liquid can form above the shoes 6, 9 and in the tubing 5 and results in a significant increase in density resulting in pressure $P_W$ at the bottom of the tail pipe 7, ultimately, resulting in a hydrostatic back pressure $P_H$ which reduces the production efficiency and may rise to a value which equals the formation pressure $P_F$. At this point production ceases making the well non-productive.

2. Description of Related Art

Attempts have therefore been made to avoid the problem and, conventionally, as shown schematically in FIG. 2, this has been achieved by means of a downhole cyclone 15 being provided at the bottom of the production casing 2, together with an electric motor/pump combination 16/17. Dual tubing strings 18, 19 are provided, with liquid being pumped, for example, to the surface, through the tubing string 18 and gas, separated in the cyclone 15, passing through the tubing string 19. A system of this general type is described in U.S. Pat. No. 6,033,567. However, one of the problems with this conventional solution is that of pump replacement. Continuously running pumps used for the purpose currently have an average run life of about 12 months so that, on a fairly regular basis, the electric motor and pump 16, 17 have to be replaced, requiring what is known as a workover to be carried out. This involves removal of the tubing strings and is an expensive and time-consuming operation which shuts down production for a significant matter of time. For low liquid volumes, the pump would have to be stopped and started repeatedly. A further problem arises in controlling the pump 17. A sensitive measuring system is required to switch off the pump to prevent gas being drawn in in the event of liquid removal being temporarily completed.

There is a need therefore for a less complex and more efficient system of liquid separation.

SUMMARY OF THE INVENTION

According to the present invention there is provided a tubular separation unit insertable into a caisson or tube for separating liquid from an upward flowing liquid/gas multi-phase stream, and comprising:

- a centrifugal flow-induced liquid separator having
  - a multi-phase gas/liquid inlet,
  - a liquid outlet, and
  - a gas stream outlet;
- a liquid transfer conduit connected to the liquid outlet of the flow separator; and
- a pump for pumping liquid, disposed below the separator and including
- a pump liquid inlet connected to the liquid transfer conduit and through which liquid separated in the separator is received, and
- a pumped liquid outlet through which separated liquid is, in use, caused to flow selectively.

Preferably, the separator comprises a tubular housing; a central tubular bore co-axial with the housing; and a helical flange disposed between the housing and the bore, the multi-phase gas/liquid inlet opening into the annular space between the housing and the bore so that the multi-phase gas/liquid mixture is caused, in use, to flow upwardly around the annular space.

The separator unit may include horizontal radial liquid guides mounted at regular intervals on the top face of the helical flange to direct any liquid flowing down on the top face of the helical flange. Further the separator may have a plurality of openings in the central bore each disposed immediately adjacent to a respective radial liquid guide and the upper side of the helical flange on the upper side of the guide and for passing liquid internally into the bore of the separator. A plurality of openings may be included in the housing each disposed immediately adjacent to a respective radial liquid guide and the upper side of the helical flange on the upper side of the guide and for passing liquid out of the separator. A shroud can be disposed adjacent each opening in the central bore on the inside of the central bore and open downwardly, to direct liquid downwardly in use along the inside of the central bore.

Longitudinally extending liquid guides are preferably mounted on the internal surface of the housing and positioned adjacent the radial liquid guides to direct liquid towards the radial guides.

Further radial liquid guides can be disposed on the underside of the helical flange between the housing and the central bore and each connected to the top of a respective extending liquid guide to direct any liquid blown up on the underside of the helical flange or forced up along the extending liquid guide.

Openings may be provided in the housing, each disposed immediately adjacent to a respective radial liquid guide and the underside of the helical flange on the lower side of the radial guide for passing liquid out of the separator. Preferably, a shroud is disposed adjacent each opening in the housing on the outside of the housing and open downwardly, to direct liquid downwardly in use along the outside of the housing.

Immediately adjacent to the upper surface of said helical flange at its lower end, one or more openings may be formed through the housing radially aligned with corresponding openings in the central bore, and an annular seal externally of the housing disposed in use between the housing and caisson or tube in which the housing is disposed, and whereby, in use, liquid between the housing and the caisson or tube is caused to flow back through the housing, across the annular space and into the central bore.

The central tubular bore may also provide the liquid transfer conduit and is preferably connected with a tubular conduit above the separator into which the gas stream outlet opens to allow outlet gas flow.

The pumped liquid outlet of the pump preferably connects with a conduit extending upwardly through the central tubular bore. A pumping power supply is suitably disposed through the central tubular bore of the separator.

The pump preferably includes a gas driven pump which comprises a housing; a liquid inlet, an external line pressure closing check valve to receive liquid from the liquid transfer conduit into the interior of the pump housing; means for injecting gas into the top of the pump housing through a liquid closing check valve; a line back pressure check valve disposed in the bottom of the pump housing; and an outlet line connected through the bottom of a pump housing to the line back pressure check valve.

The invention also includes a method of removing liquid from an upward flowing liquid/gas multi-phase stream in a caisson or tube, including:

separating liquid from the multi-phase liquid/gas stream centrifugally in a flow separator and passing it to an outlet;

transferring the liquid through a conduit connected to the outlet of the flow separator to a pump disposed below the separator; and pumping liquid to a liquid outlet through which separated liquid is removed.

Preferably, the multi-phase liquid/gas stream flows substantially helically within the separator. For handling a low to medium velocity liquid/gas multi-phase stream, the separated liquid flows downwardly along an inside housing wall of the separator to the liquid outlet. For handling a high velocity predominately gas, liquid/gas multi-phase stream, separated liquid is forced upwardly along the inside of an outer wall of the separator and is directed through the wall into a space between the caisson/tube and the separator.

The method may be used for separating liquid from a predominately liquid, liquid/gas multi-phase stream.

BRIEF DESCRIPTION OF THE DRAWINGS

One example of a method and apparatus according to the present invention will now be described with reference to the accompanying drawings in which.

DESCRIPTION OF THE PRESENTLY PREFERRED EMBODIMENTS

Figure 1:
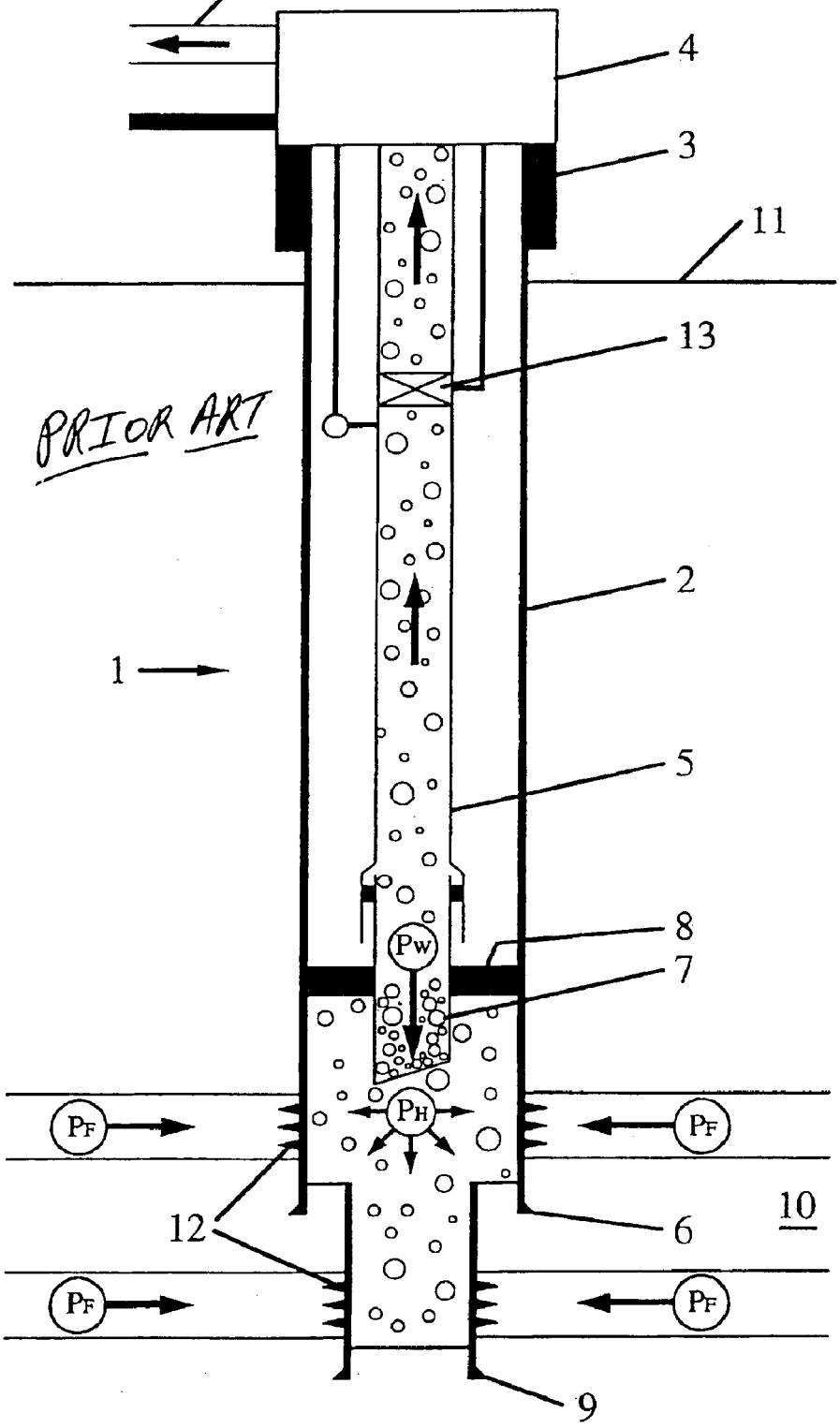
FIG. 1 is a example schematic illustration of a typical, prior art, gas well completion.
Figure 2:
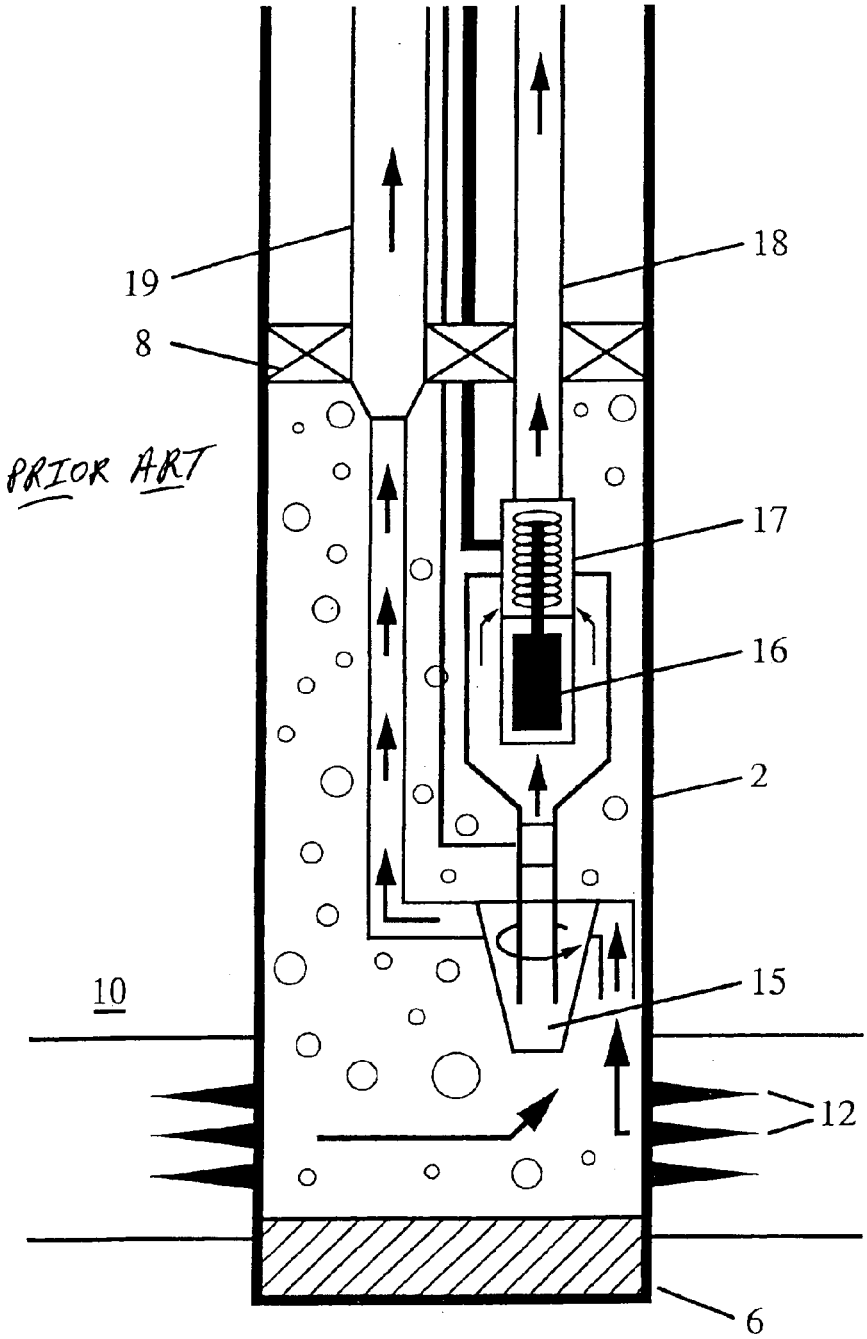
FIG. 2 shows a prior art downhole cyclone system provided at the bottom of the production casing.
Figure 3:
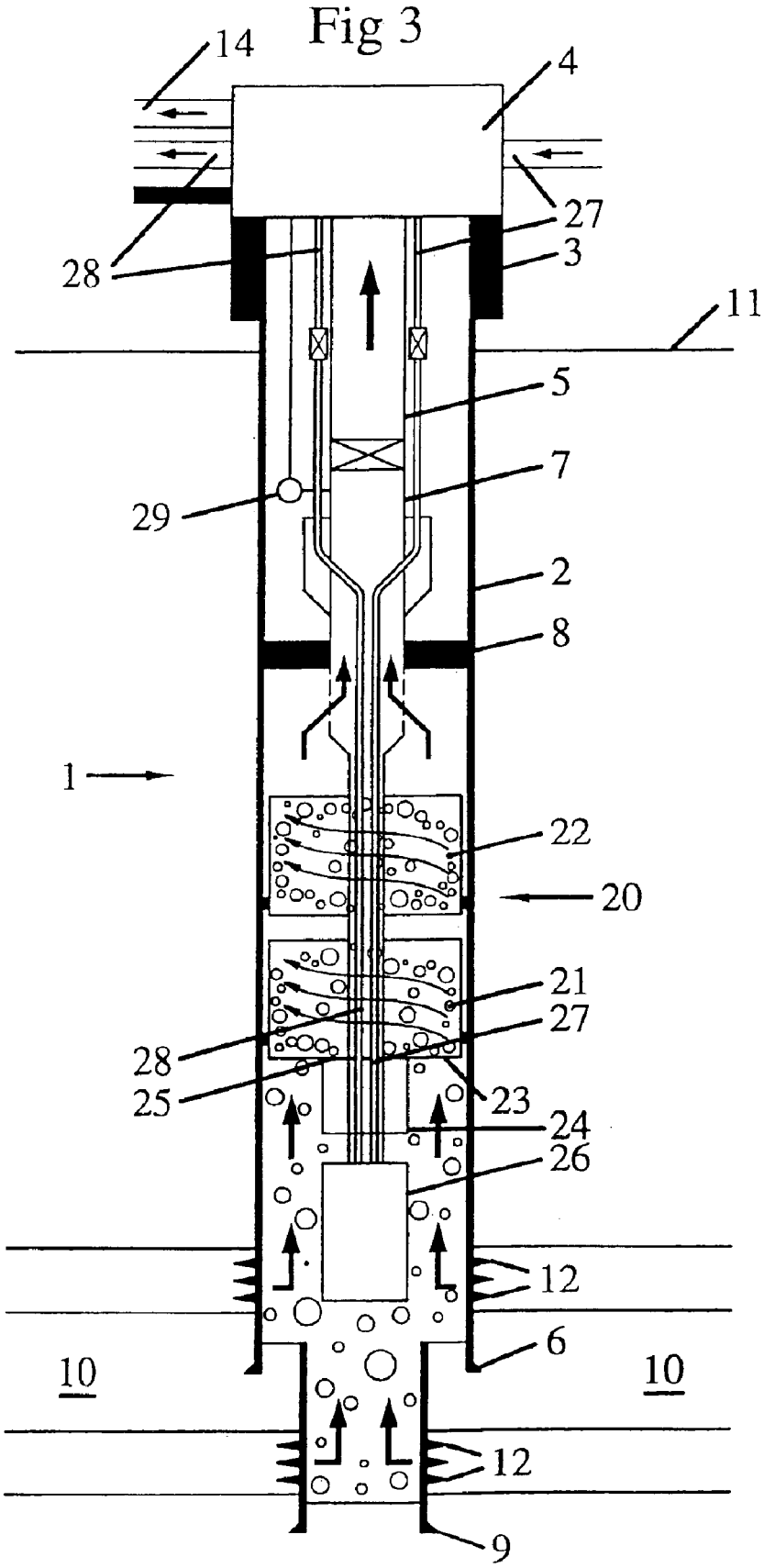
FIG. 3 illustrates, diagrammatically, in accordance with the invention, a longitudinal section through a well.

The concept of the present invention is illustrated in FIG. 3. A tubular separation unit 20 includes one or more (two as shown) centrifugal flow-induced liquid separator or separators 21, 22 with a lower inlet 23 for the multi-phase liquid/gas stream flowing in above the shoes 6, 9 through the perforations 12, at the bottom of the casing 2 and casing liner above shoe 9. Liquid and gas are separated in the centrifugal separators 21, 22 and liquid separated from the gas passes through a transfer conduit or sleeve 24 from an outlet 25 into a pump 26, which is a gas injection pump, and, under the pressure of gas fed to the pump from a gas operation line 27, liquid is removed through a liquid outlet line 28.

Separated gas is allowed to flow into the production tubing 5 and up to tree 4 inside the casing 2. Well pressure and temperature monitors 29 are provided as conventional.

Figure 4:
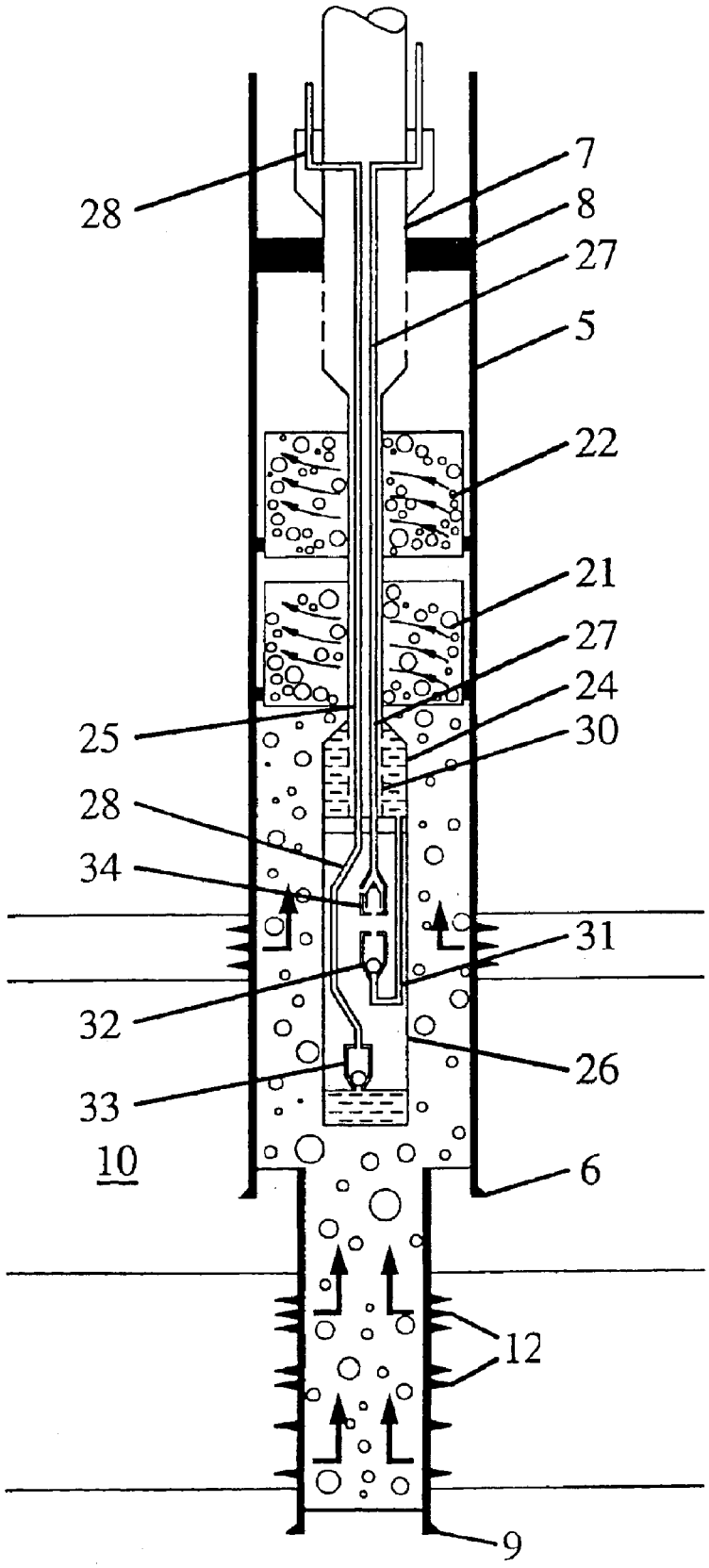
FIG. 4 shows the lower end of the well in more detail, in particular, detail of a liquid transfer and holding conduit or sleeve.

The lower end of the well 1 is illustrated in somewhat more detail in FIG. 4 which, in particular, shows detail of the liquid transfer and holding conduit or sleeve 24 and the gas injection pump 26. In operation liquid separated in the separators 21, 22 (as will be described in more detail later) is collected in the sleeve 24 after passing from the outlet 25 of the separators 21, 22, via a perforate inlet pipe 30. From the transfer/storage sleeve 24, an outlet pipe 31 extends downwardly into the pump 26 and is turned through 180° and has an exit closed by a check valve 32. The check valve 32 is opened when the pressure of liquid is sufficient in line 31 and closes when there is a higher pressure in the pump 26. Liquid builds up in the pump 26 and, as a result of gas pressure within the pump 26, is pumped out through the out line 28 via a further check valve 33. Gas is supplied from the gas operation line 27 through a floating check valve 34 which is operable to close the gas operation line 27 to prevent liquid ingress.

Figure 5:
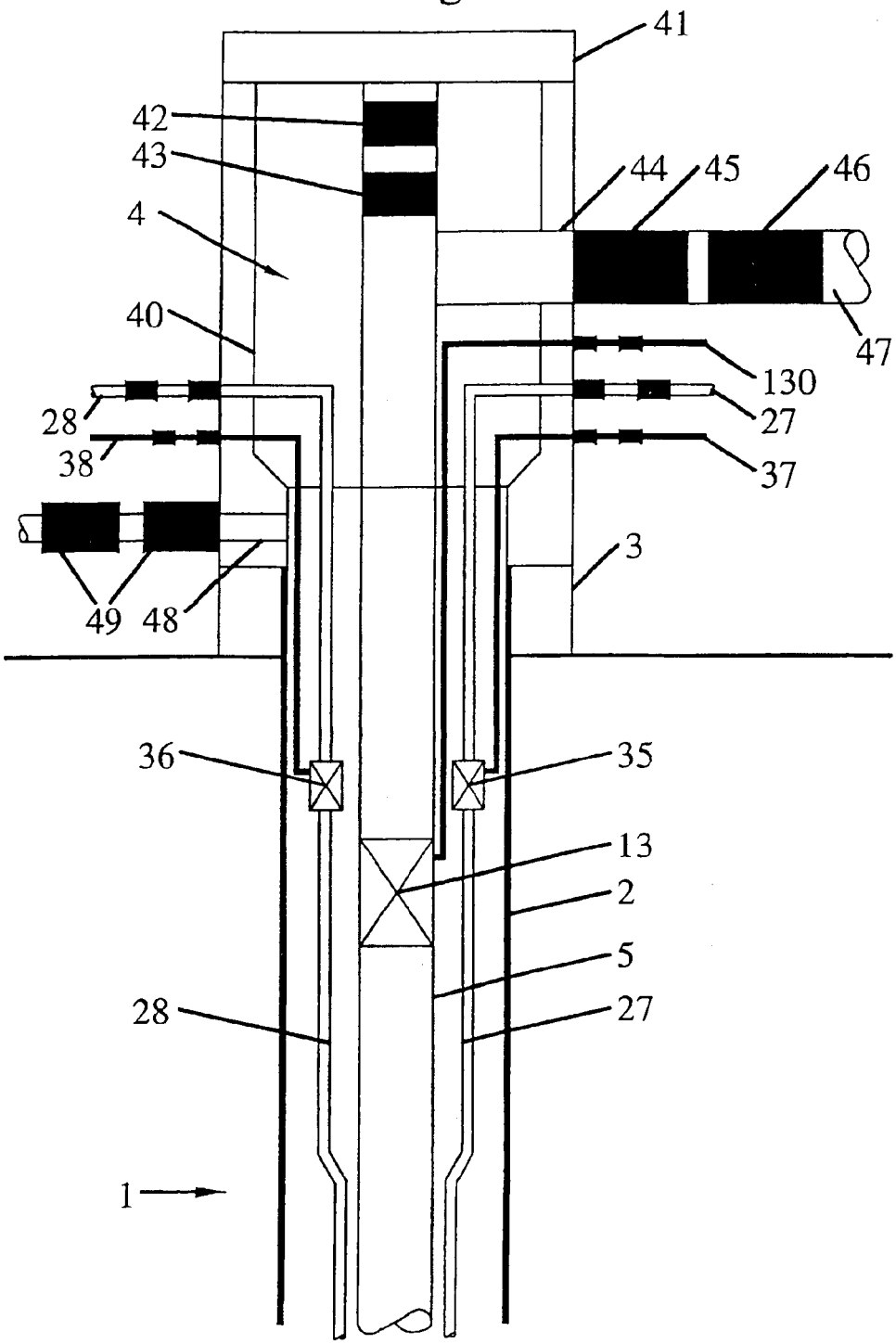
FIG. 5 illustrates the top of a surface well.

FIG. 5 illustrates the top of a surface well 1, again schematically, and shows the wellhead 3 suspending the top of the well casing 2 with the production tubing 5, gas operation line 27 and liquid output line 28 shown extending therethrough. Subsurface safety valves 35, 36 are connected to the gas operation line 27 and liquid output line 28 respectively, being controlled by hydraulic lines 37, 38, respectively. The tree 4 has the tubing hanger 40, a fire cap 41, production tubing plugs 42, 43, and a production outlet port 44. A master valve 45 and a production isolation valve 46 are also shown in the production output line 47. The production tubing subsurface safety valve 13 is operated via a hydraulic line 130 and the casing annulus, i.e., around the production tubing 5 within the casing 2 is vented through a port 48 with an appropriate valves 49. The centrifugal separation units 21, 22, will now be described in more detail with reference to FIGS. 6 to 9. The separator units 21, 22, are substantially identical and therefore only one of them will be described.

Figure 6:
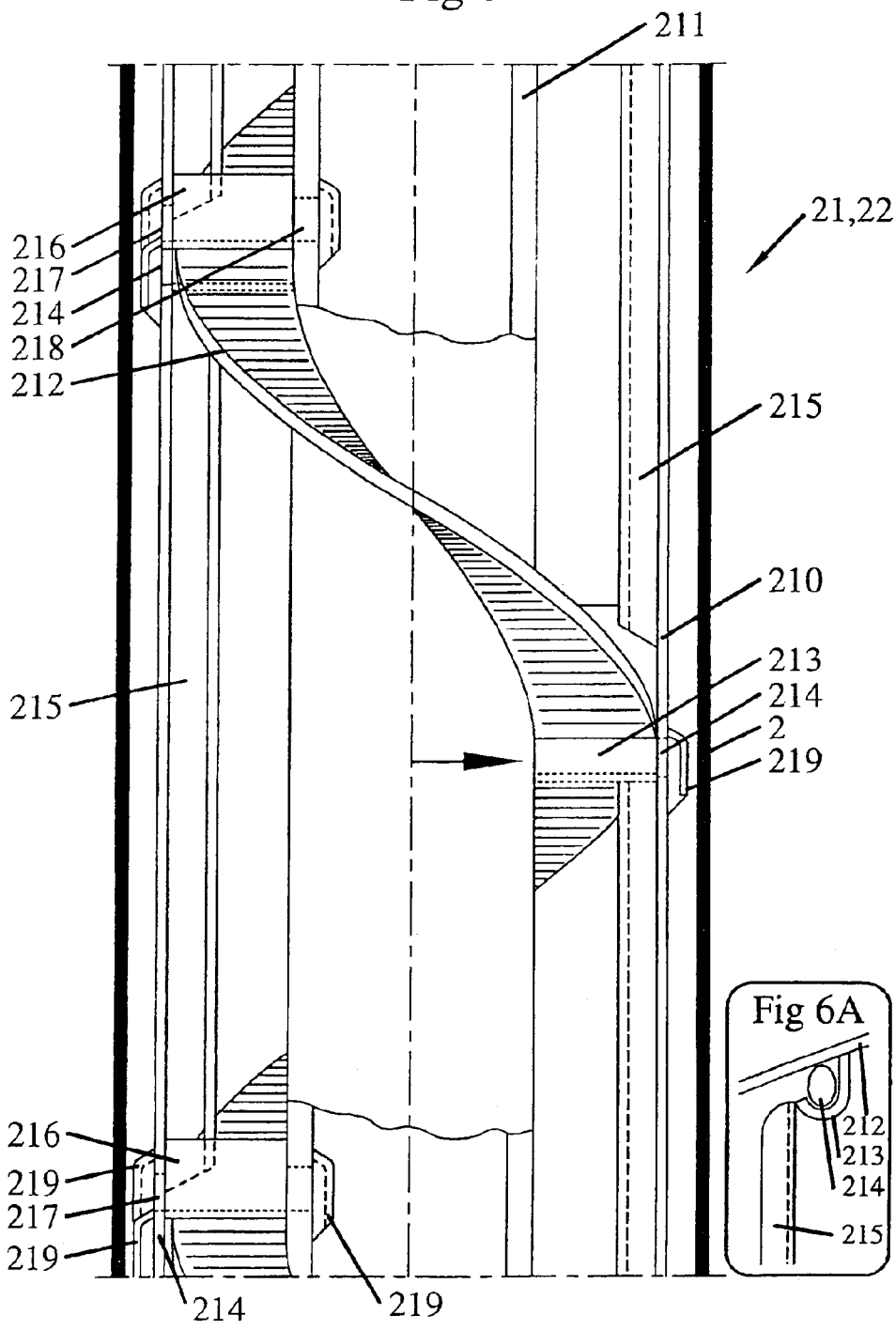
FIGS. 6 to 9 illustrate longitudinal and partial cross-sections through separator units employed in a unit according to the invention.
Figure 7:
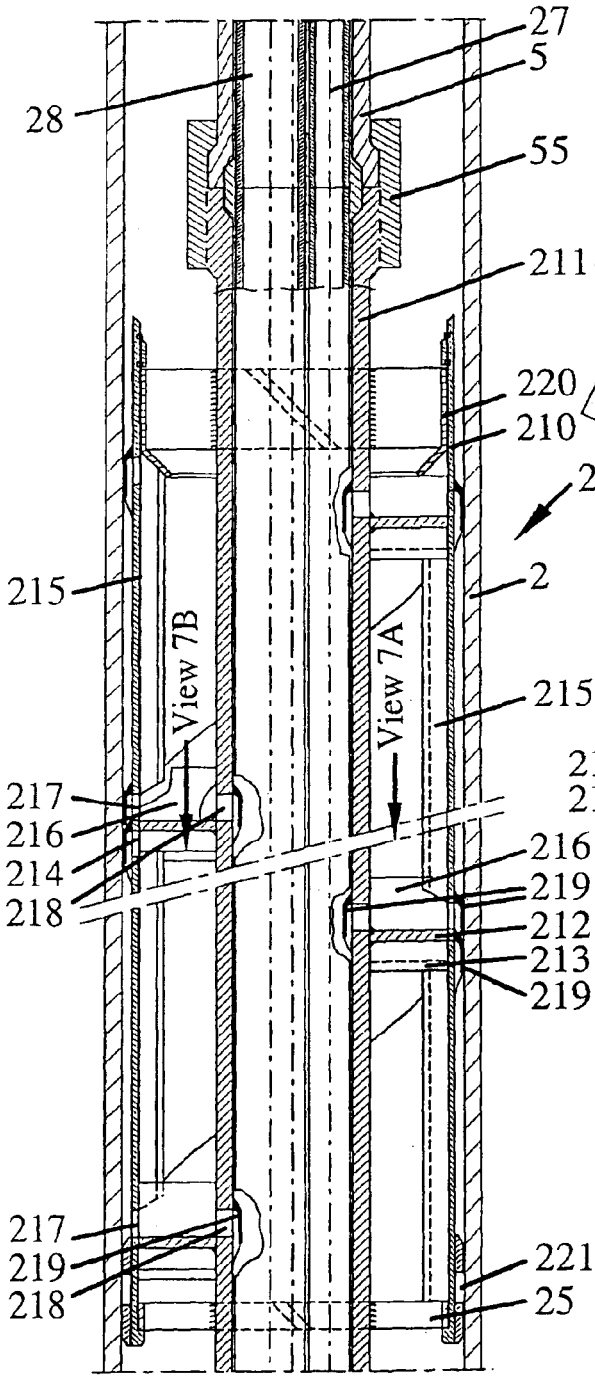
Figure 7A:
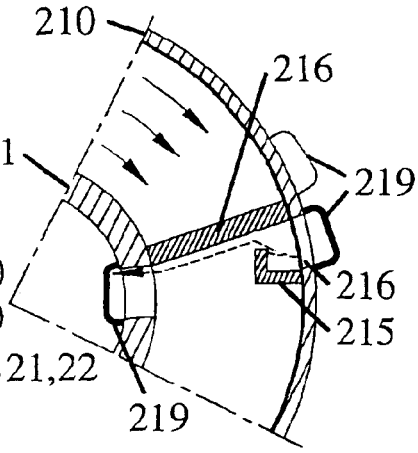
Figure 7B:
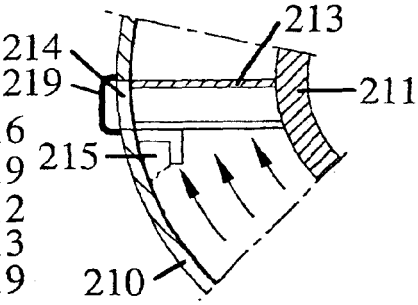
Figure 8:
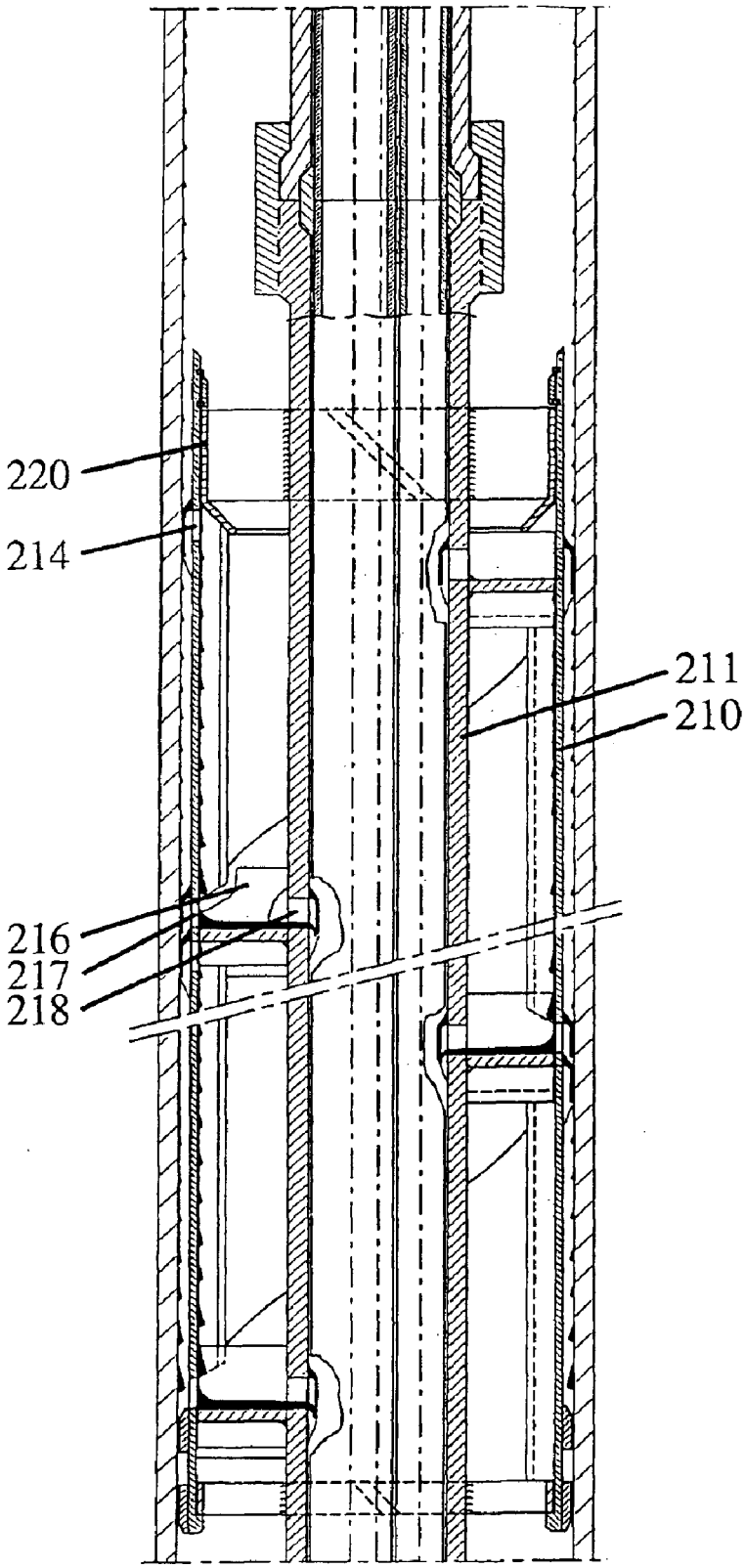
Figure 9:
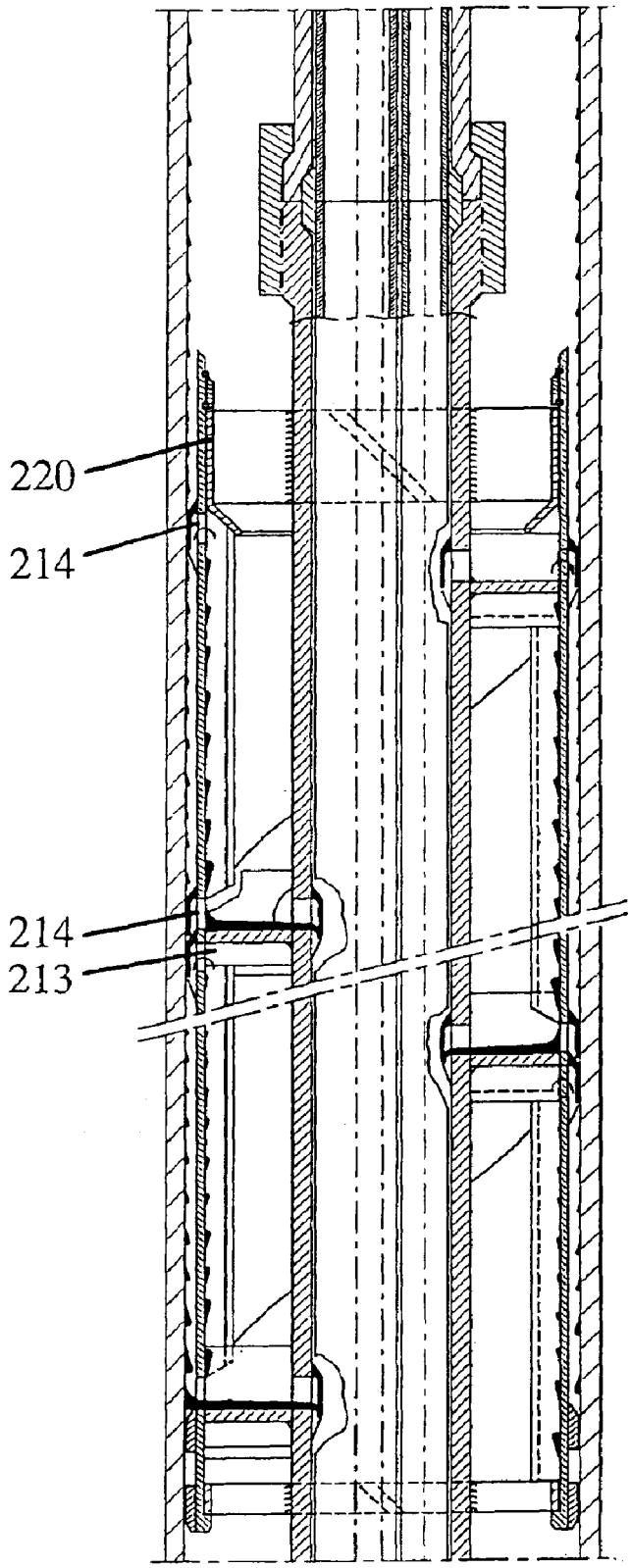

FIGS. 6 and 7 show part of a separator unit whereas FIGS. 8 and 9 show the whole unit.

The separator unit has a tubular housing 210 which is sized to fit with a clearance calculated to collect the anticipated volume of liquid separated, within the well casing 2. Coaxial with the housing 210 is an inner bore 211 which forms part of the production outlet in use. Helically disposed around the bore 211 and occupying the whole radial extent of the annulus between the bore 211 and the housing 210 is a flange 212. Adjacent to the underside of the flange, at regular intervals of the bore 211 are provided horizontally extending guides 213 which are lined with openings 214 through the housing 210. For clarity the diagrams show a diametrically opposite configuration. Arranged parallel to the axis of the bore 211 and housing 210, are arranged elongate guides 215 and above the flange are disposed radial guides 216 adjacent to the radial guides 216 on the upper side of the flange 212 openings 217 and 218, respectively in the housing of 210 and the bore 211 are formed. Each of the openings 214, 217, 218, has a corresponding shroud 219 disposed on the outlet side of the opening. The shrouds 19 provide a resistance to allowing the gas to exit through the holes and prevent downward flowing liquid from above flowing back into the main annulus especially in deviated well bores.

At the top of the separator unit 21, the bore 211 is connected to the production tubing string outlet 5 by means of a conventional connection 55 and through the bore 211 and the tubing string 5 extend the gas operation line 27 and the liquid outlet line 28. An upper part-thrustor conical and part cylindrical flange 220 extends partly across the annulus from the housing 210 towards the bore 211. A wiper seal 221 seals the lower end of the housing 210 inside the casing 2 around the multi-phase liquid/gas inlet 25.

The space above each separator 21, 22 acts as a condensing section, by creating a possible pressure drop and lower velocity because of the larger area, thus creating further liquid drop out and condensation. Furthermore, the final swirl created by the flange 220 can cause moisture precipitation on the inside wall of the casing 2 which runs down and is collected between the casing and the tubular housing 210. The gas is then channelled into the tubing, moving at high velocity and preventing further liquid drop out, by allowing liquid to be blown upwardly in the tubing.

The operation of the separator unit will now be further described.

The liquid/gas mixture flows upwardly under pressure at the bottom of the well 1 through the casing 2, enters the separator through the inlet 25 and is forced to flow in a helical path around the bore 211 by means of the helically flange 212. The upward rotational flow causes liquid to be separated from the gas and thrown, centrifugally, outwardly against the inside face of the housing 210. It is partially collected by the longitudinal guides 215 and then, under gravity, as long as the gas velocity is relative low, the collected liquid flows out of the housing 210 through the openings 217 having been trapped by the radial guides 216. Depending upon the volume of liquid collected it may also flow inwardly through the openings 218 in the bore 211. Liquid flowing downwardly around the outside of the casing 210 flows to the bottom where it is prevented from flowing further along the inside of the casing 2 by the seal 221 and then flow inwardly through the opening 217, across the bottom end of the flange 212 and through to the inside of the bore 211 via the opening 218. This is seen most clearly in FIG. 8 where the liquid flow is shown in solid black shading.

FIG. 9 illustrates the high gas velocity condition in which liquid separated from the gas is not able to flow downwardly along the inside of the housing 210 but instead flows upwardly and then exits the housing through the openings 214, being trapped by the transfer guides 213 on the underside of the flange 212. At the top of the separator unit the flange 220 provides a final rotational flow to the existing gas stream into a larger condensing area by creating a lower pressure and lower velocity section. This allows further condensation and liquid separation against the inside surface of the casing 2. Any liquid running down the inside wall of the casing 2 will be collected between casing 2 and housing 210 and appropriately channelled through the assembly.

The operational cycle of the apparatus shown in FIGS. 3 to 9 will now be described further with reference to FIGS. 10 through 17 .

Figure 10:
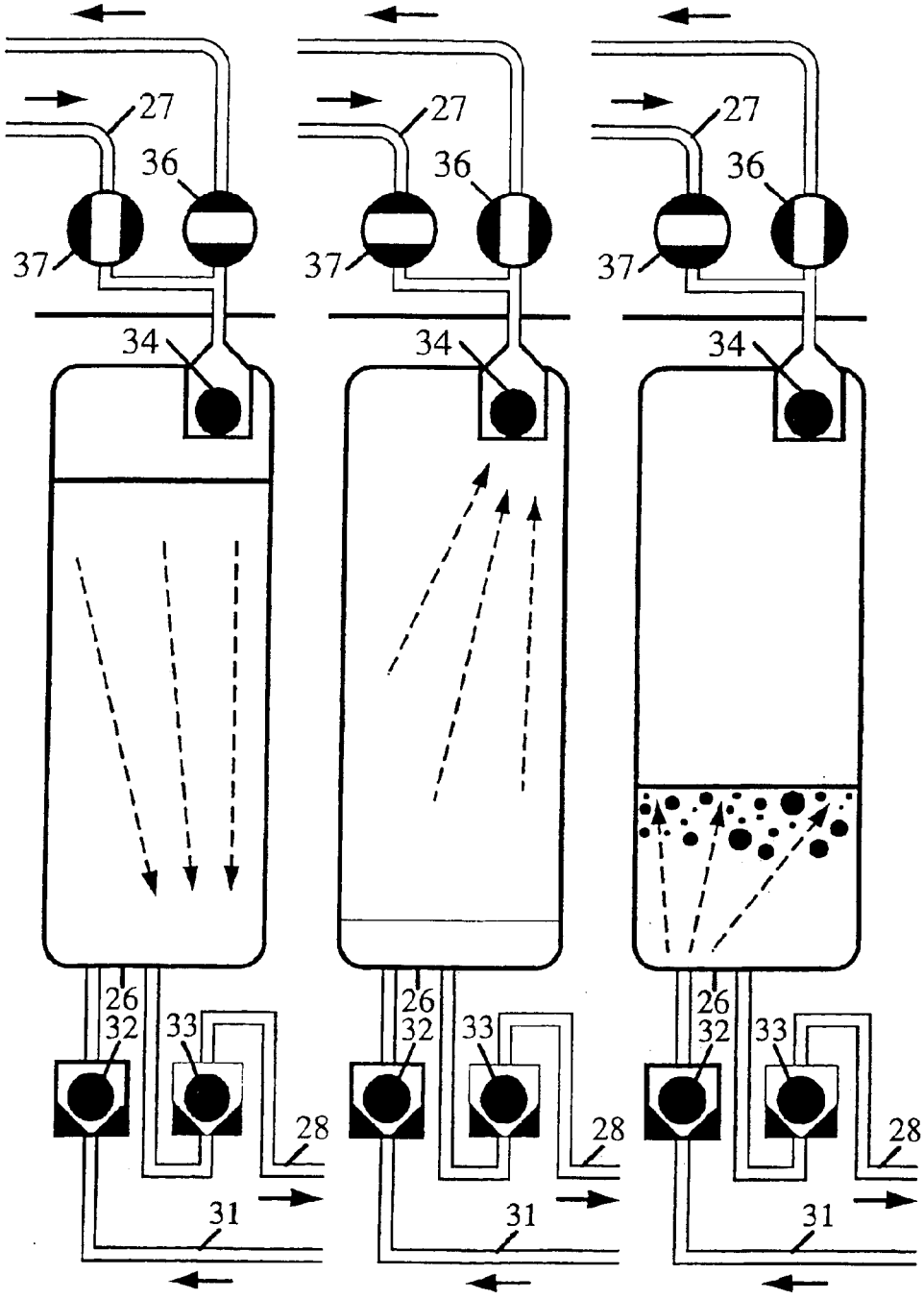
FIG. 10 shows three different parts of a pumping cycle for such a unit.

FIG. 10 shows three different parts of the pumping cycle, the pump 26 and its associated components being indicated very schematically in three side-by-side views. During separation of liquid from the multi-phase liquid/gas flow, liquid gradually fills the pump 26 from the transfer conduit/storage sleeve 24 via the inlet line 31 and the check valve 32. The check valve 34 remains open and allows low pressure gas return through an outlet valve 36 located externally to the tree in a control unit. The high pressure operating gas inlet 27 remains closed by a valve 37. The check valve 33 remains closed by the hydrostatic line pressure.

Once the volume of liquid collected in the pump 26 has risen sufficiently to close the float valve 34, a sensor in the control unit senses the drop in pressure and operates the controls to open the gas inlet valve 37 after closing the vent valve 36 and liquid is then caused to flow through the outlet check valve 33 and the liquid outlet line 28 to the tree 4 . Once the pump is empty and gas enters line 28. A sensor in the control unit senses the drop in supply gas pressure due to the reduced head in return line 28 as shown in the central figure, and closes the inlet valve 37 and opens the vent valve 36 to end the pumping phase and allow gas to be vented from the pump 36. Filling of the pump 26 then recommences as shown on the right hand side of the figure.

Figure 11:
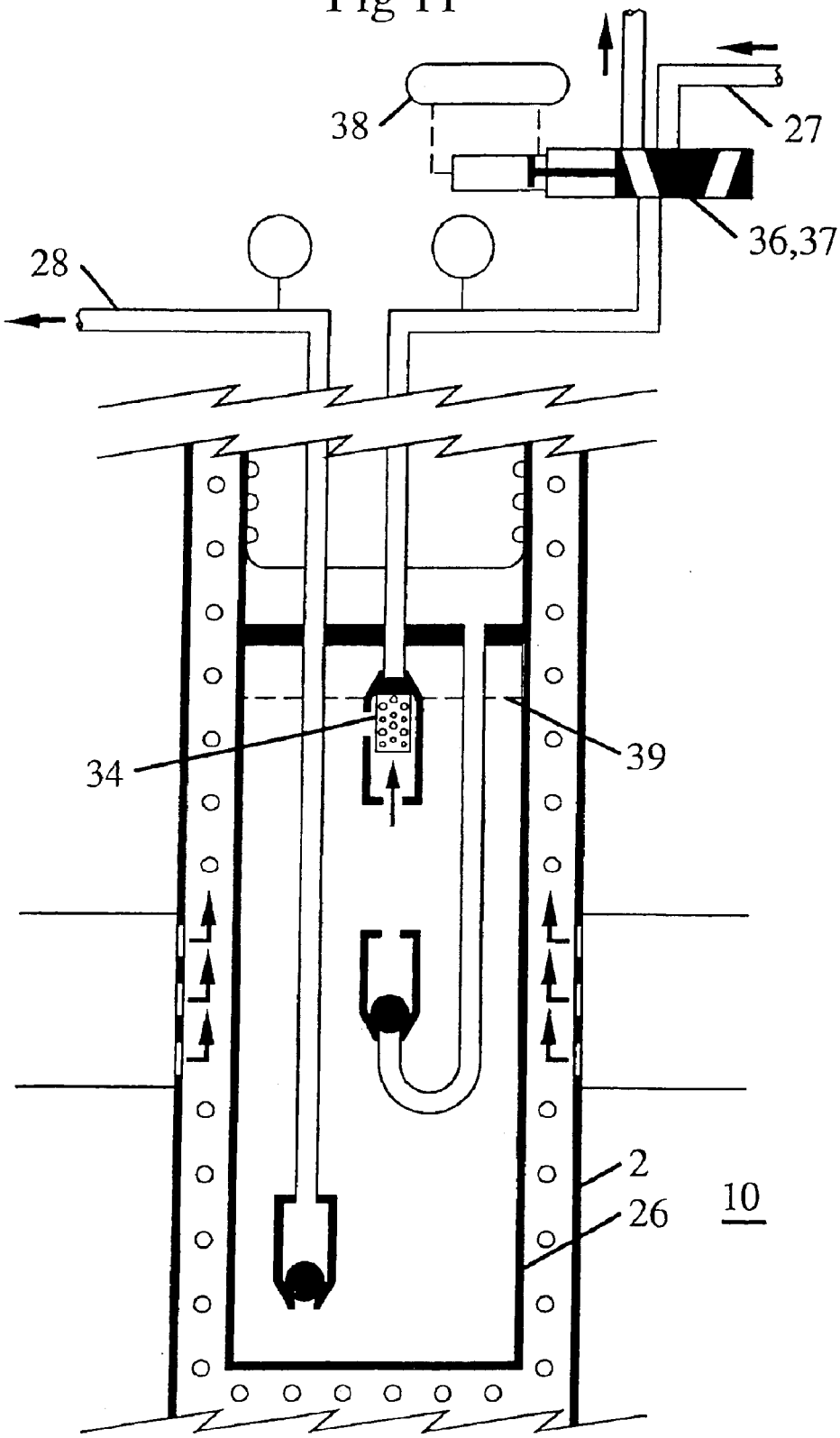
FIGS. 11 to 15 show various stages of the pumping cycle.
Figure 12:
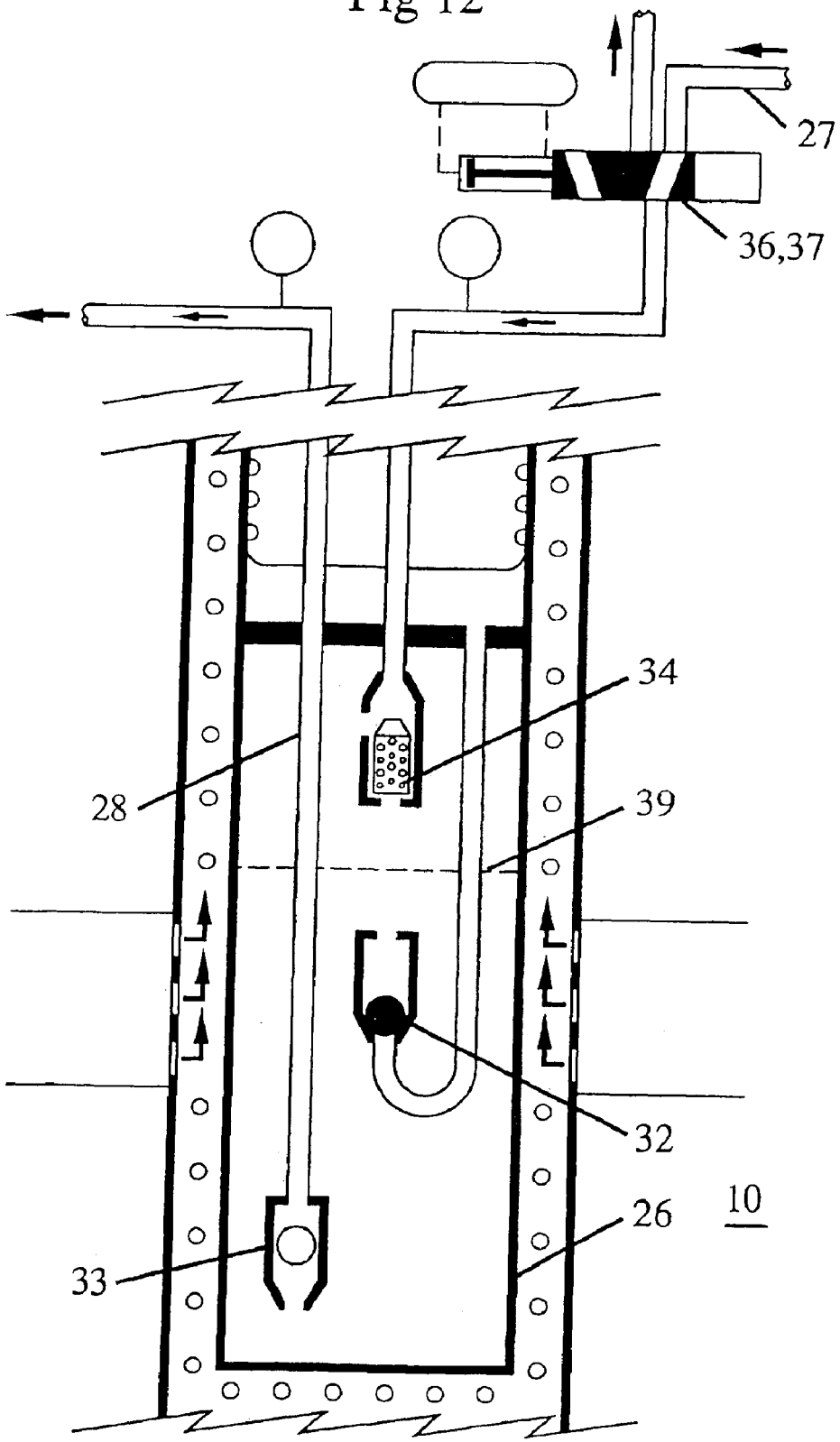
Figure 13:
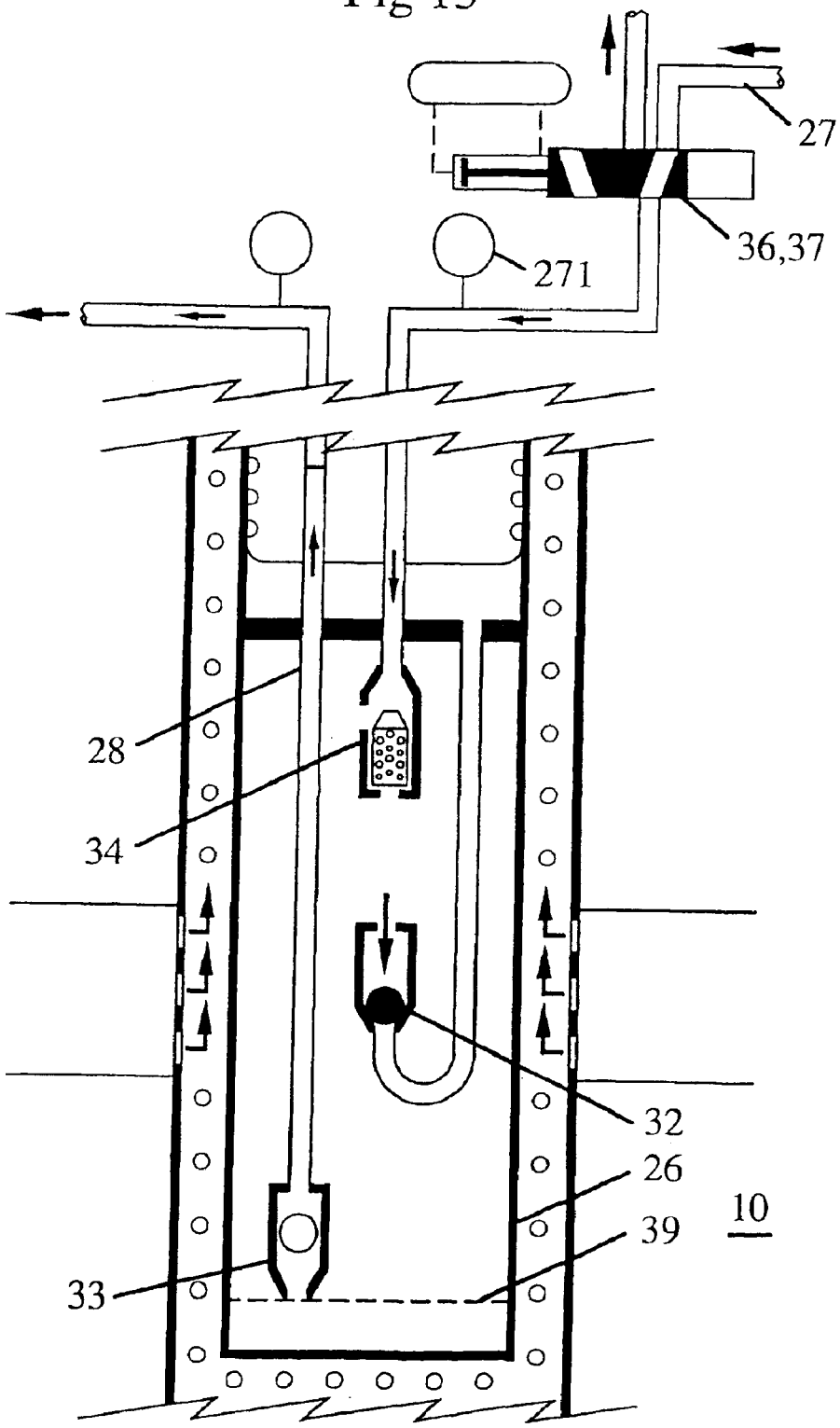
Figure 14:
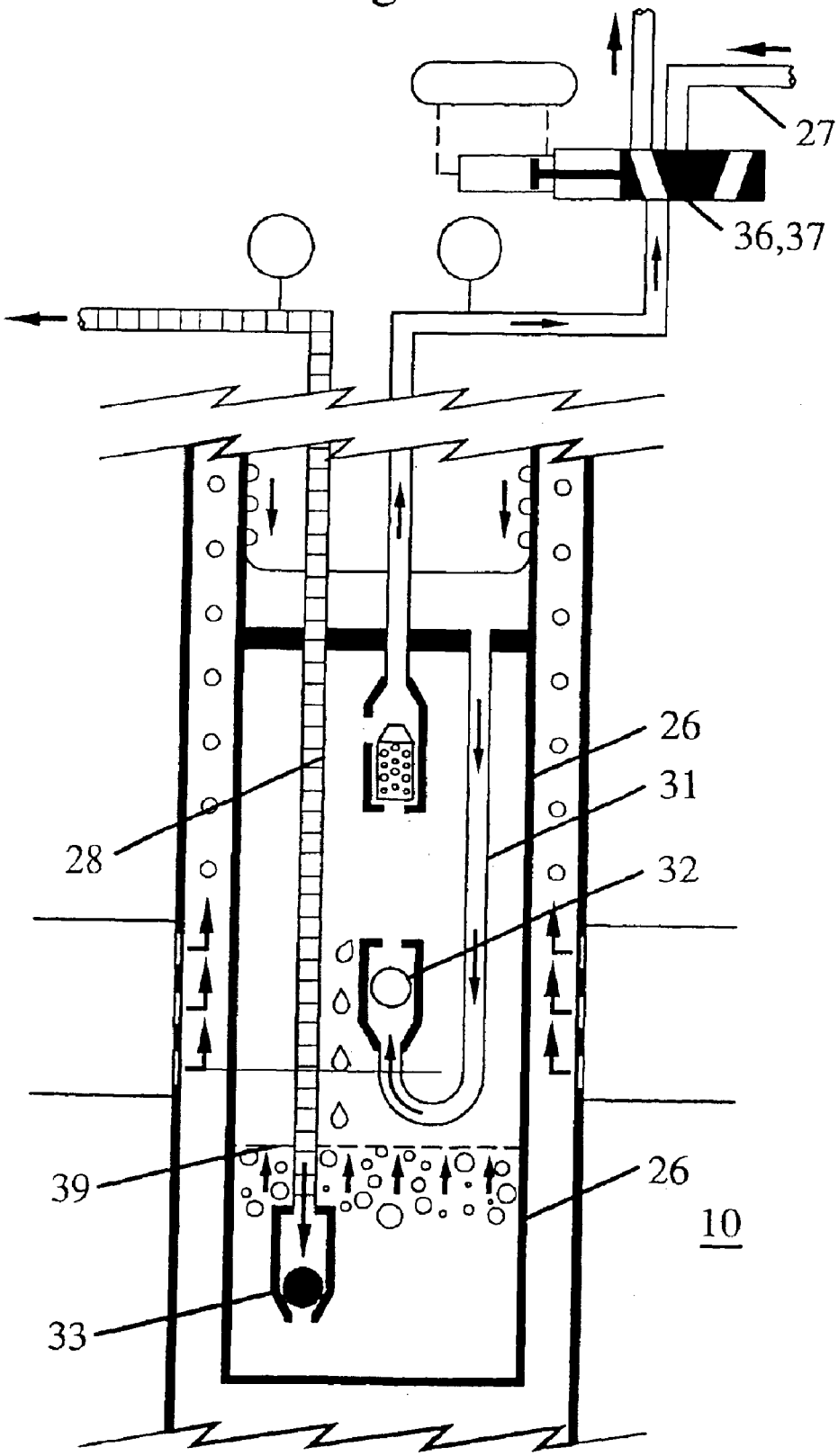
Figure 15:
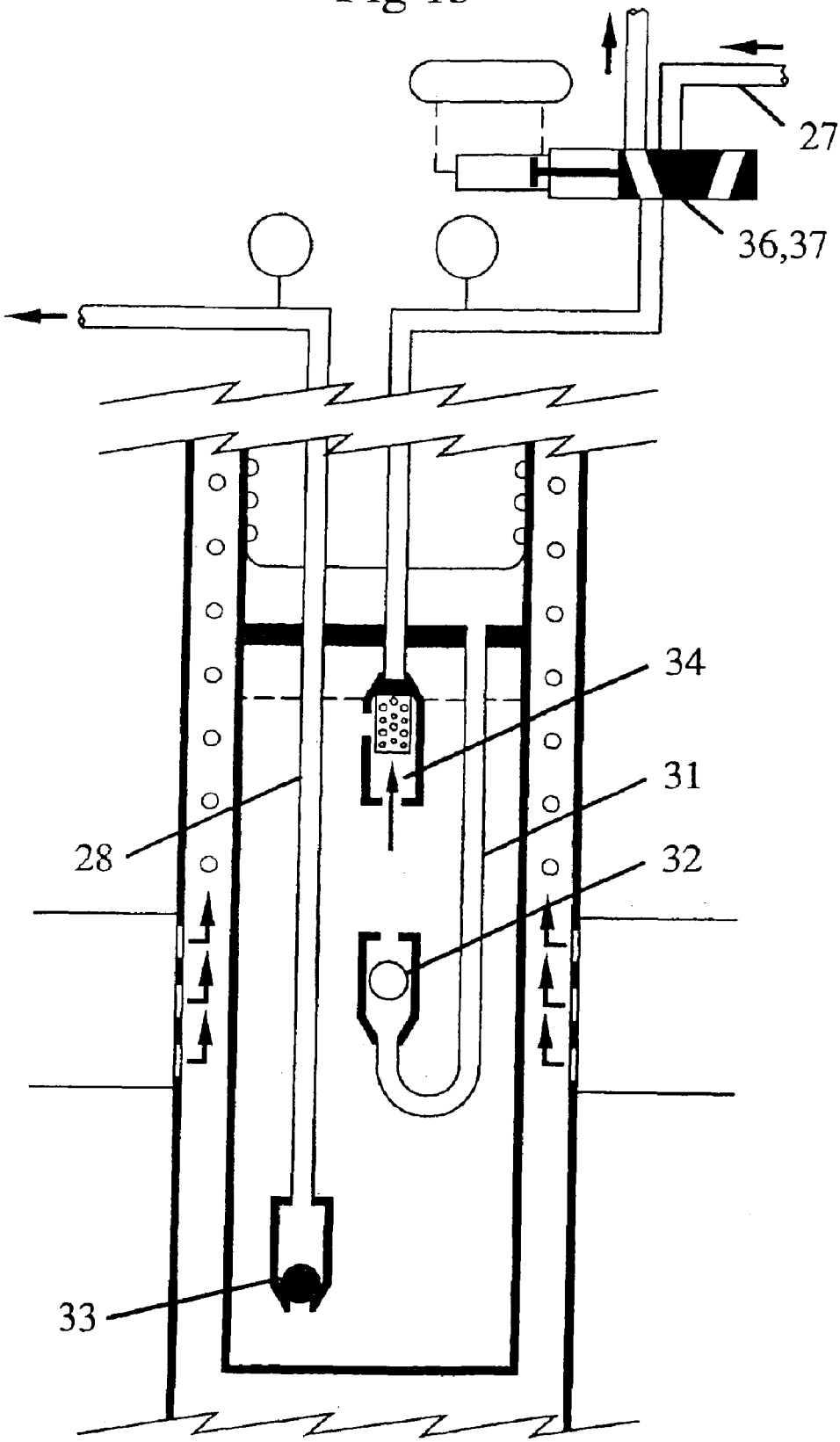

FIGS. 11 to 15 show various stages of the pumping cycle, the gas valves 36, 37 being shown as a single shuttle valve with a controller 38. FIG. 11 shows the liquid in the pump 26 at its full level as indicated by the dotted line 39, the float valve 34 being shown in its closed position and line 27 pressured down. At this point pumping commences by operating valves 36, 37 and FIG. 12 shows the approximate mid point of the pumping stage with the liquid level 39 having been lowered to the position shown under the action of high-pressure gas from the operational gas line 27. The check valve 33 is open and liquid is pumped to the tree through the outlet line 28, the float valve 34 is open as indicated. The check valve 32 remains closed. At the end of the pumping stage as shown in FIG. 13, the pump 26 is effectively empty and as high pressure gas starts to flow through the check valve 33, the change in hydrostatic pressure in line 28 affects the pressure in the gas operation line 27 which is sensed by a sensor 271 and the valve 36, 37 is moved to allow gas to be vented through the check valve 34 and liquid starts filling the pump 26 through the inlet 31 through the check valve 32 as shown in FIG. 14. The check valve 32 remains open as the liquid level 39 rises above it and continues to fill the pump 26 as illustrated in FIG. 15, allowing further gas separation from the liquid due to the low pressure. When full the float valve 34 is closed. Pumping then recommences as described above.

Figure 16:
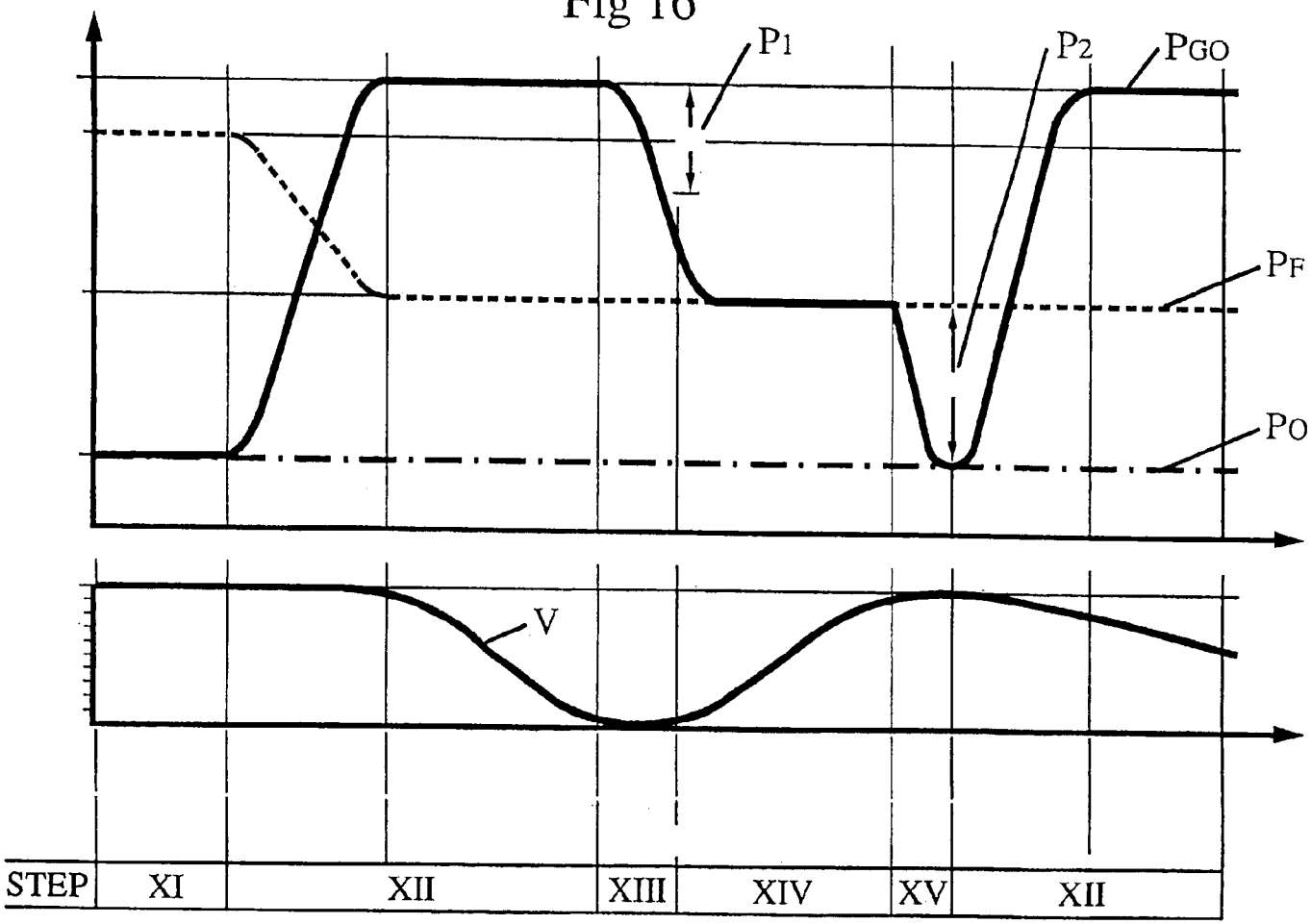
FIG. 16 is a graph of pressures during a typical pump cycle.

As an example only, but appreciating that different well parameters will result in different performance curves, FIG. 16 shows pressures during a typical pump cycle, the upper chart shows pressure/time curves and the lower chart, the liquid volume in the pump at the same time as in the upper chart. FIG. 16 illustrates the steps shown in FIGS. 11 through 15, the different steps being indicated by Roman numerals corresponding to the figure number showing the different stages of the cycle. The liquid volume in the pump is indicated by the lower line V. The upper chart shows the bottom hole pressure by the dotted line $P_F$, the gas operation line pressure at the tree by the line $P_{GO}$ and the gas export or outlet line pressure in the outlet tubing string by the chain-dotted line $P_O$. Step XI illustrates the shut in position with the pump having been filled. Initially, the pressure $P_F$ is the well closed-in pressure with the gas operation line pressure $P_{GO}$ vented down to the gas export line pressure.

On opening the well, the gas export line pressure $P_F$ drops to the gas flowing pressure. The gas operation line is switched in with high gas pressure raising $P_{GO}$. When the pressures have stabilised, Step XII commences.

Step XII illustrates the pump emptying with a constant high gas pressure maintaining $P_{GO}$.

Step XIII Illustrates the pump empty and high pressure gas displacing fluid in the return line 28 and subsequently a loss in head occurs. The pressure in the gas operating line will drop, lowering pressure $P_{GO}$, until the control 38 recognises a set pressure drop $P_1$ is reached which switches valves 36/37 as shown in Step XIV.

Step XIV illustrates the pump filling with liquid through line 31 as the gas operating line pressure $P_{GO}$ vents down to the gas export pipe line pressure $P_O$. Any fluid in line 28 is held in place by check valve 33. This continues until the pump is full of liquid which closes the float check valve 34 as shown in Step XV.

Step XV illustrates the full pump with the closed check valve 34, but as the gas operating line is now venting to the gas export line, the gas operating line is subjected to a notable drop in pressure which the controller can detect as $P_2$. The controller then switches the valves 36/37 to provide high pressure gas to the gas operating line 27 which restarts the cycle as per Step XII.

Figure 17:
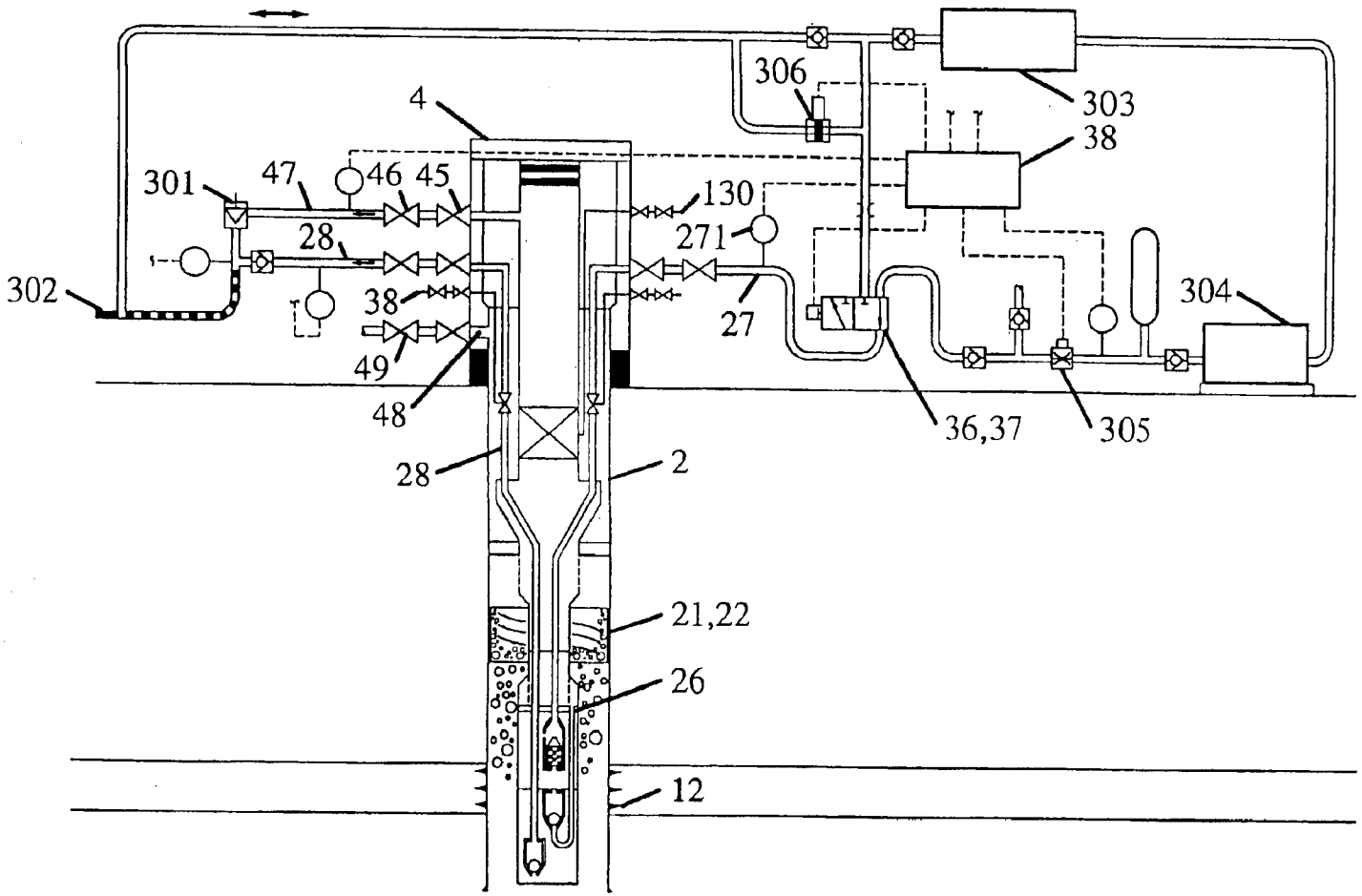
FIG. 17 illustrates, schematically the whole of the apparatus both down-hole and surface located, to provide a simple schematic to aid understanding of the operations.

An example of an operating system which is external to the tree is shown in FIG. 17 which illustrates, schematically the whole of the apparatus both down-hole and surface located, to provide a simple schematic to aid understanding of the operations. This schematic shows the produced gas in line 47 being controlled by a choke 301 and pumped liquid in the line 28 being commingled down stream of the tree into the export line. Individual export lines could be used to maintain separation.

Vented gas from line 27 can be recirculated from the valves 36/37 or drawn from the gas export line 302, through a filter/scrubber unit 303 to a high pressure compressor 304. High pressure gas flow is regulated by 305 before entering valve 36/37. To maximise the use of partially vented down gas, a power activated valve 306 is installed to improve efficiency. Alternatively, a separate gas high pressure supply can be provided or a separate low pressure line to the compressor could be used. A controller 38 operates the tree, monitors the numerous pressure lines and controls; the choke 301, valve 36/37, and the compressor, as per the field operators instructions.

The operation of the downhole annulus separation and pumping system whether on the surface (land or platform) or subsea can be operated external to well and tree by observing the two pressure step changes ($P_1$ and $P_2$) in the gas operating line 27. There is no need for in-well sensors or data equipment which could be susceptible to failure and prevent production from the well.

The well completion discussed assumes the separated liquid is pumped up to the tree, but in certain circumstances part of the well bore may be past a liquid disposal zone.

For a liquid disposal zone below the production zone, the liquid line 28 would go down the well through an isolation packer between the two zones to allow liquid injection into the lower zone.

For an upper zone, the liquid line would terminate above the packer 8 and appropriate perforations in the casing 2 by the liquid disposal zone would allow injection.

The diagrams have all shown for simplicity the system mounted in a vertical well, but the system will also operate in deviated (ie. angled) wells. For highly deviated wells, seal 221 would be part of a straight extension to the tubular housing 210 with ports above the seals piped across to the inner bore 211. The length of the straight extension will determine the maximum deviated angle of the well.

The separation system shown could be used with other types of pump (i.e., rotary electric, hydraulic or gas driven) if there is a high volume of separated liquids. In a caisson, silo, riser or conductor system there is the option of using an external pump to the containment vessel. In this scenario, there is no need for a tree, providing that appropriate valving is provided.

What is claimed is:

1. A tubular separation unit insertable into a caisson or tube for separating liquid from an upward flowing liquid/gas multi-phase stream, and comprising:

a centrifugal flow-induced liquid separator having
- a multi-phase gas/liquid inlet,
- a liquid outlet, and
- a gas stream outlet;

a liquid transfer conduit connected to the liquid outlet of the flow separator; and a pump for pumping liquid, disposed below the separator and including
- a pump liquid inlet connected to the liquid transfer conduit and through which liquid separated in the separator is received,
- a pumped liquid outlet through which separated liquid is, in use, caused to flow selectively;

the separator comprises,
- a tubular housing;
- a central tubular bore co-axial with the housing; and
- a helical flange disposed between the housing and the bore, the multi-phase gas/liquid inlet opening into the annular space between the housing and the bore so that the multi-phase gas/liquid mixture is caused, in use, to flow upwardly around the annular space; and the separator unit further including horizontal radial liquid guides mounted at regular intervals on the top face of the helical flange to direct any liquid flowing down on the top face of the helical flange.

2. A separation unit according to claim 1, further including a plurality of openings in the central bore each disposed immediately adjacent to a respective radial liquid guide and the upper side of the helical flange on the upper side of the guide and for passing liquid internally into the bore of the separator.

3. A separation unit according to claim 2, further including a shroud disposed adjacent each opening in the central bore on the inside of the central bore and open downwardly, to direct liquid downwardly in use along the inside of the central bore.

4. A separation unit according to claim 3, further including a plurality of longitudinally extending liquid guides mounted on the internal surface of the housing and positioned adjacent the radial liquid guides to direct liquid towards the radial guides.

5. A separation unit according to claim 4, further including a plurality of further radial liquid guides disposed on the underside of the helical flange between the housing and the central bore and each connected to the top of a respective extending liquid guide to direct any liquid blown up on the underside of the helical flange or forced up along the extending liquid guide.

6. A separation unit according to claim 5, further including a plurality of openings in the housing each disposed immediately adjacent to a respective radial liquid guide and the underside of the helical flange on the lower side of the radial guide for passing liquid out of the separator.

7. A separation unit according to claim 6, further including a shroud disposed adjacent each opening in the housing on the outside of the housing and open downwardly, to direct liquid downwardly in use along the outside of the housing.

8. A separation unit according to claim 7, further including, immediately adjacent to the upper surface of said helical flange at its lower end, one or more openings through the housing radially aligned with corresponding openings in the central bore, and an annular seal externally of the housing disposed in use between the housing and caisson or tube in which the housing is disposed, and whereby, in use, liquid between the housing and the caisson or tube is caused to be directed through the housing, across the annular space and into the central bore.

9. A separation unit according to claim 8, wherein the central tubular bore also provides the liquid transfer conduit.

10. A separation unit according to claim 9, wherein the central tubular bore is connected with a tubular conduit above the separator into which the gas stream outlet opens to allow outlet gas flow.

11. A separation unit according to claim 10, wherein the pumped liquid outlet of the pump connects with a conduit extending upwardly through the central tubular bore.

12. A separation unit according to claim 11, including a pumping power supply disposed through the central tubular bore of the separator.

13. A separation unit according to claim 12, wherein the pump includes a gas driven pump.

14. A separation unit according to claim 13, wherein the gas driven pump comprises:

a housing;

a liquid inlet, an external line pressure closing check valve to receive liquid from the liquid transfer conduit into the interior of the pump housing;

means for injecting gas into the top of the pump housing through a liquid closing check valve;

a line back pressure check valve disposed in the bottom of the pump housing; and an outlet line connected through the bottom of a pump housing to the line back pressure check valve.

15. A separation unit according to claim 14, the unit having an external operating system for controlling and monitoring the operation of the unit.

16. A separation unit according to claim 1, further including a plurality of openings in the housing each disposed immediately adjacent to a respective radial liquid guide and the upper side of the helical flange on the upper side of the guide and for passing liquid out of the separator.

17. A separation unit according to claim 16, further including a plurality of longitudinally extending liquid guides mounted on the internal surface of the housing and positioned adjacent the radial liquid guides to direct liquid towards the radial guides.

18. A separator unit according to claim 17, further including a plurality of further radial liquid guides disposed on the underside of the helical flange between the housing and the central bore and each connected to the top of a respective extending liquid guide to direct any liquid blown up on the underside of the helical flange or forced up along the extending liquid guide.

19. A separator unit according to claim 18, further including a plurality of openings in the housing each disposed immediately adjacent to a respective radial liquid guide and the underside of the helical flange on the lower side of the radial guide for passing liquid out of the separator.

20. A separation unit according to claim 19, further including a shroud disposed adjacent each opening in the housing on the outside of the housing and open downwardly, to direct liquid downwardly in use along the outside of the housing.

21. A separation unit according to claim 20, further including, immediately adjacent to the upper surface of said helical flange at its lower end, one or more openings through the housing radially aligned with corresponding openings in the central bore, and an annular seal externally of the housing disposed in use between the housing and caisson or tube in which the housing is disposed, and whereby, in use, liquid between the housing and the caisson or tube is caused to be directed through the housing, across the annular space and into the central bore.

22. A separation unit according to claim 21, wherein the central tubular bore also provides the liquid transfer conduit.

23. A separation unit according to claim 22, wherein the central tubular bore is connected with a tubular conduit above the separator into which the gas stream outlet opens to allow outlet gas flow.

24. A separation unit according to claim 23, wherein the pumped liquid outlet of the pump connects with a conduit extending upwardly through the central tubular bore.

25. A separation unit according to claim 24, including a pumping power supply disposed through the central tubular bore of the separator.

26. A separation unit according to claim 25, wherein the pump includes a gas driven pump.

27. A separation unit according to claim 26, wherein the gas driven pump comprises:

a housing;

a liquid inlet, an external line pressure closing check valve to receive liquid from the liquid transfer conduit into the interior of the pump housing;

means for injecting gas into the top of the pump housing through a liquid closing check valve;

a line back pressure check valve disposed in the bottom of the pump housing; and an outlet line connected through the bottom of a pump housing to the line back pressure check valve.

28. A separation unit according to claim 27, the unit having an external operating system for controlling and monitoring the operation of the unit.

29. A method of removing liquid from an upward flowing liquid/gas multi-phase stream in a caisson or tube, including:

separating liquid from the multi-phase liquid/gas stream centrifugally in a flow separator and passing it to an outlet;

the centrifugal flow-induced liquid separator having a multi-phase gas/liquid inlet, a liquid outlet, and a gas stream outlet;

transferring the liquid through a liquid transfer conduit connected to the liquid outlet of the flow separator to a pump for pumping liquid disposed below the separator and including a pump liquid inlet connected to the liquid transfer conduit and through which liquid separated in the separator is received, pumping liquid to a liquid outlet through which separated liquid is, in use, caused to flow selectively;

the separator comprises, a tubular housing;

a central tubular bore co-axial with the housing; and a helical flange disposed between the housing and the bore, the multi-phase gas/liquid inlet opening into the annular space between the housing and the bore so that the multi-phase gas/liquid mixture is caused, in use, to flow upwardly around the annular space; and, the separator unit further including horizontal radial liquid guides mounted at regular intervals on the top face of the helical flange to direct any liquid flowing down on the top face of the helical flange.

30. A method according to claim 29, wherein the multi-phase liquid/gas stream flows substantially helically within the separator.

31. A method according to claim 30, for handling a low to medium velocity liquid/gas multi-phase stream, wherein the separated liquid flows downwardly along an inside housing wall of the separator to the liquid outlet.

32. A method according to claim 31, for handling a high velocity predominately gas, liquid/gas multi-phase stream, wherein separated liquid is forced upwardly along the inside of an outer wall of the separator and is directed through the wall into a space between the caisson/tube and the separator.

33. A method according to claim 32, for separating liquid from a predominately liquid, liquid/gas multi-phase stream.

* * * * *